US007356284B2

(12) United States Patent
Yamada et al.

(10) Patent No.: US 7,356,284 B2
(45) Date of Patent: Apr. 8, 2008

(54) IMAGE FORMING DEVICE

(75) Inventors: Katsumi Yamada, Saitama (JP); Takao Uchida, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 59 days.

(21) Appl. No.: 11/400,636

(22) Filed: Apr. 10, 2006

(65) Prior Publication Data

US 2007/0041746 A1 Feb. 22, 2007

(30) Foreign Application Priority Data

Aug. 18, 2005 (JP) ..... 2005-237446

(51) Int. Cl.
*G03G 15/00* (2006.01)

(52) U.S. Cl. ..... 399/162; 399/167

(58) Field of Classification Search ..... 399/162, 399/167

See application file for complete search history.

(56) References Cited

U.S. PATENT DOCUMENTS 5,421,255 A * 6/1995 Kryk ..... 399/162
5,778,287 A * 7/1998 Yu ..... 399/167
6,308,031 B1 * 10/2001 Hiroe ..... 399/167

FOREIGN PATENT DOCUMENTS

| | | |
|---|---|---|
| JP | A-02-199464 | 8/1990 |
| JP | A-04-155352 | 5/1992 |
| JP | A-10-268595 | 10/1998 |

* cited by examiner

*Primary Examiner*—Sandra L. Brase
(74) *Attorney, Agent, or Firm*—Morgan, Lewis & Bockius LLP

(57) ABSTRACT

An image forming device comprises; an endless-belt shaped image carrier that circulates along a predetermined locus of movement and is trained around a plurality of rollers, the plurality of rollers being structured by at least one driving roller that receives driving force from a drive source and drives, and driven rollers that do not have drive force, a dynamic friction connecting unit that, by dynamically-frictionally connecting the driving roller and at least one of the driven rollers under a predetermined dynamic friction coefficient, dynamically-frictionally drives the at least one driven roller by driving force of the driving roller.

20 Claims, 4 Drawing Sheets

PRINTING ACCURACY

±200 μm
0
1.02
1.05
Dmain/Dsub
DRIVING LOAD 0
1.05 1.06
Dmain/Dsub

IMAGE FORMING DEVICE

CROSS-REFERENCE TO RELATED APPLICATION

This application claims priority under 35 USC 119 from Japanese Patent Application No. 2005-237446, the disclosure of which is incorporated by reference herein.

BACKGROUND

1. Technical Field

The present invention relates to an image forming device utilizing an electrophotographic system such as a printer, a copier, a fax machine, or the like. In particular, the present invention relates to an image forming device which forms an image in accordance with a predetermined printing sequence, and which has an image forming engine section which develops an electrostatic latent image, which is formed by charging and exposure by a light beam, and transfers the toner image, which is made visible, from an image carrier onto a transfer member.

2. Related Art

In a conventional monochromatic image forming device using a photosensitive belt as an image carrier, when fluctuations in the speed of photosensitive belt arise, there are the problems that elongation and contraction arise in the finished image such that warping is caused at the image, and in an image having information such as a barcode or the like, that information cannot be read.

In a color image forming device which forms a finished image by superposing two or more colors in a similar structure having a photosensitive belt, there is the fatal problem of color offset between the respective colors increasing due to, in addition to the above-described problem of elongation and contraction and the like of a single-color image, non-uniform rotating speed of the photosensitive belt or a transfer belt.

Fluctuations in the speed of a photosensitive belt tend to arise when the driving load is large. In a color image forming device, the driving load tends to increase even more in particular when there is a structure in which a plurality of developing devices are lined-up at the outer periphery of the photosensitive belt, or when there are members which slidingly-contact the inner and outer peripheral sides of the photosensitive belt without being slave-driven (or while rotating in the opposite direction), or the like.

There are cases in which periodic non-uniformity in the rotating and driving of the drive source itself, e.g., a motor, is caused due to the aforementioned driving load. Further, there are cases in which slight slippage arises between the photosensitive belt and the surface of a driving roller, which is formed of an elastic member and around which the inner peripheral surface of the photosensitive belt is trained and which guides the circulating movement of the photosensitive belt, such that unsystematic non-uniformity of rotation is caused.

SUMMARY

In view of the aforementioned, the present invention provides an image forming device.

A first aspect of the present invention is an image forming device comprising an endless-belt shaped image carrier that circulates along a predetermined locus of movement and is trained around a plurality of rollers, the plurality of rollers being structured by at least one of driving roller that receives driving force from a drive source and drives, and driven rollers that do not have drive force, a dynamic friction connecting unit that, by dynamically-frictionally connecting the driving roller and at least one of the driven rollers under a predetermined dynamic friction coefficient, dynamically-frictionally drives the at least one driven roller by driving force of the driving roller.

BRIEF DESCRIPTION OF THE DRAWINGS

An embodiment of the present invention will be described in detail based on the following figures, wherein:

FIG. 4A is a diagram showing a pulley diameter ratio—printing accuracy characteristic, and FIG. 4B is a diagram showing a pulley diameter ratio—driving load (motor current value) characteristic.

DETAILED DESCRIPTION (Overall Structure)

Figure 1:
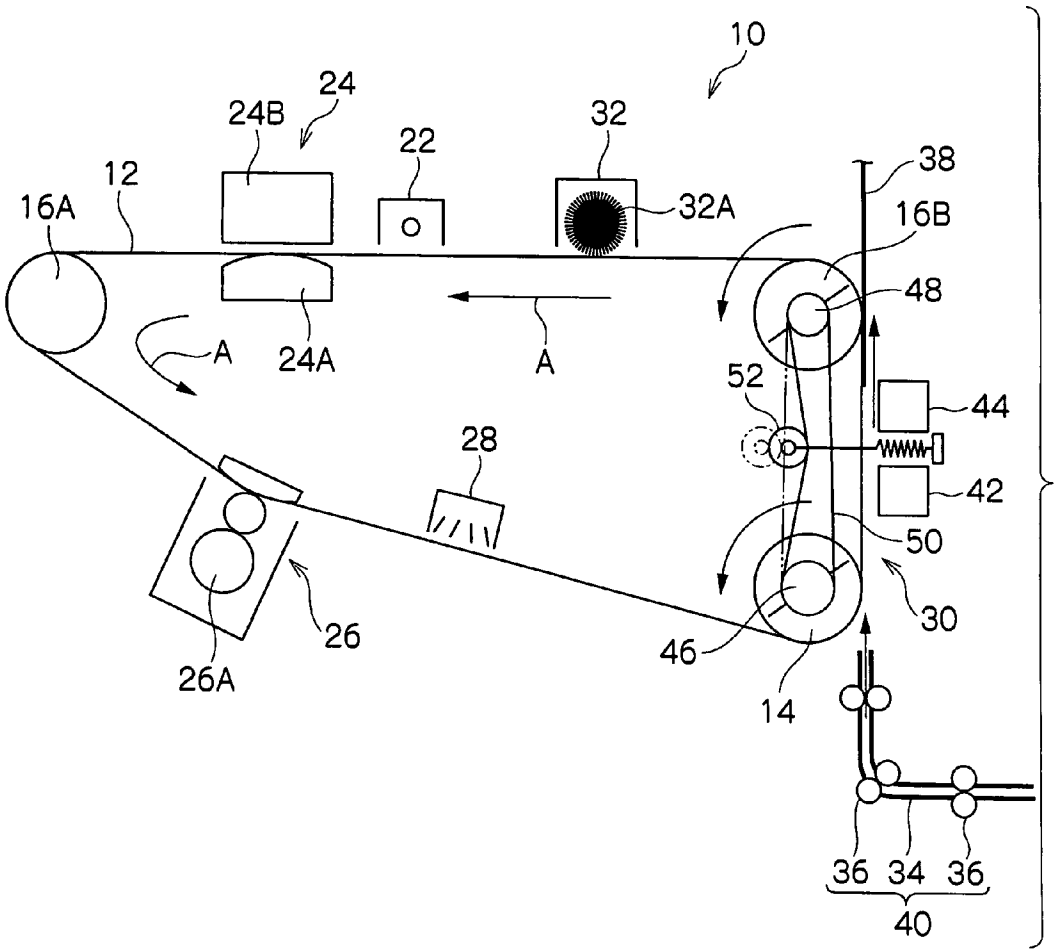
FIG. 1 is a schematic diagram of an engine section of an image forming device relating to the embodiment.
Figure 2:
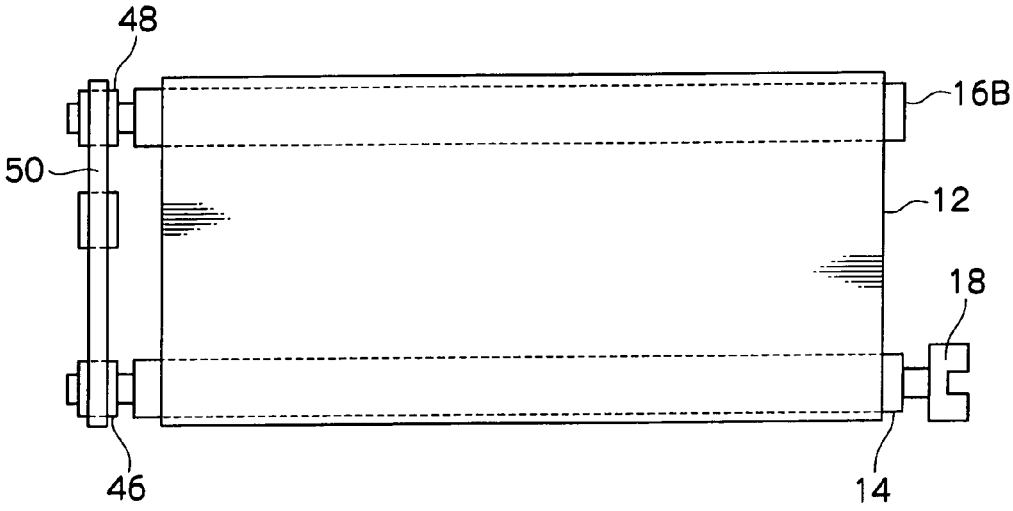
FIG. 2 is a right side view of FIG. 1.

An engine section 10 of a monochromatic printer relating to the present embodiment is shown in FIGS. 1 and 2.

The engine section 10 is structured mainly such that a photosensitive belt 12 serving as an image carrier is trained around one driving roller 14 and a plurality of (two in the present embodiment) driven rollers 16A, 16B.

The driving roller 14 is connected, via a coupling 18 (see FIG. 2), to the rotating shaft of a motor 20 (see FIG. 3) serving as a drive source. The driving roller 14 is rotated at a uniform speed by the driving force of the drive source.

Due to the photosensitive belt 12 being guided and supported by the driving roller 14 and the driven rollers 16A, 16B, the photosensitive belt 12 receives driving force from the driving roller 14, and can circulate along the direction of arrow A in FIG. 1 along a predetermined locus.

The surfaces of the surface layers of the driving roller 14 and the driven rollers 16A, 16B are covered by an elastic material (rubber), and contact the inner peripheral surface of the photosensitive belt 12. The inner peripheral surface of the photosensitive belt 12 is PET (polyethylene terephthalate), and is designed such that the dynamic friction coefficient between this inner peripheral surface and the aforementioned rubber is high, and in particular, such that there is hardly any slippage between the driving roller 14 and the photosensitive belt 12 due to the driving load.

A charging section 22, an exposure section 24, a developing section 26, a charge-removing section 28, a transfer section 30, and a cleaner section 32 are disposed along the direction of arrow A in FIG. 1 at appropriate positions of the aforementioned locus of circulation of the photosensitive belt 12.

The charging section 22 is a first process of the image forming processing, and is positioned at the substantially horizontal conveying region of the photosensitive belt 12. The surface (outer peripheral surface) of the photosensitive belt 12 is charged uniformly at the charging section 22.

When the uniformly-charged photosensitive belt 12 reaches the exposure section 24, an electrostatic latent image is formed due to the illumination of a light beam which is illuminated from a light beam scanning device 24B which is disposed such that the photosensitive belt 12 is sandwiched between the light beam scanning device 24B and a platen 24A. Note that, in the present embodiment, LEDs are used as the light source. The LEDs are lined-up in the main scanning direction. The light from the LEDs is collected at an optical system such as Selfoc lenses or the like. The LEDs are lit and extinguished on the basis of image data.

The photosensitive belt 12, on which the electrostatic latent image is formed, is substantially inverted by the driven roller 16A which is positioned at the left end in FIG. 1. Thereafter, the photosensitive belt 12 reaches the developing section 26.

At the developing section 26, while toner which is stored in a toner tank 26A is stirred, the toner is supplied to the surface (the outer peripheral surface) of the photosensitive belt 12, and the electrostatic latent image on the photosensitive belt 12 is thereby made visible. The charge-removing section 28 is disposed at the inner peripheral surface of the photosensitive belt 12 in a vicinity of the downstream side of the developing section 26, and resets the charged state of the photosensitive belt 12.

When the image which has been made visible (hereinafter called "toner image") passes by the charge-removing section 28, the photosensitive belt 12 reaches a position at which the direction thereof is switched substantially 90° by the driving roller 14. The region which is directed vertically in FIG. 1 from this position is the transfer section 30.

The position where the driving roller 14 is disposed structures a conveying path section 40 of a recording sheet 38 which is a transfer member. The conveying path section 40 is structured by guide members 34 and conveying rollers 36 which are disposed at the lower right portion in FIG. 1.

The recording sheet 38 is conveyed along the conveying path 40, and, from the position where the driving roller 14 is disposed, is conveyed while tightly contacting the photosensitive belt 12 which is moving in the aforementioned vertical direction.

A transfer charging section 42 and a charge-removing charging section 44 are provided in the transfer section 30 at the recording sheet 38 side (the side facing the surface of the recording sheet 38 which surface is at the opposite side of the image transfer surface).

In the transfer section 30, the toner image formed on the photosensitive belt 12 is transferred onto the recording sheet 38. The recording sheet 38 after transfer is conveyed as is along the conveying direction of the transfer section 30 (the vertical direction), passes through an unillustrated fixing section, and is discharged to the exterior of the device.

On the other hand, the direction of the photosensitive belt 12 is switched substantially 90° by the driven roller 16B positioned at the final end of the transfer section 30 (the upper right end in FIG. 1), and the photosensitive belt 12 reaches the substantially horizontal conveying region at which the above-described charging section 22 and exposure section 24 are disposed.

The cleaner section 32 is disposed at the upstream side of the charging section 22. The toner which remains on the photosensitive belt 12 is scraped off by a brush 32A of the cleaner section 32, and the photosensitive belt 12 has thus completed one rotation.

(Driving Load Reducing Structure)

Here, in the present embodiment, as described above, the contact between the photosensitive belt 12 and the driving roller 14 is contact between rubber and PET, and the dynamic friction coefficient is high. However, when driving load which is greater than or equal to that anticipated is applied (e.g., at the time when driving starts, at the time of supplying toner at the developing section 26, at the time of transfer onto the recording sheet 38 at the transfer section 30, and the like), the driving load concentrates on the contact surfaces of the driving roller 14 and the photosensitive belt 12, and slipping may arise.

Thus, in the present embodiment, there is added a structure which enlarges (disperses) the driving transfer region.

Figure 3:
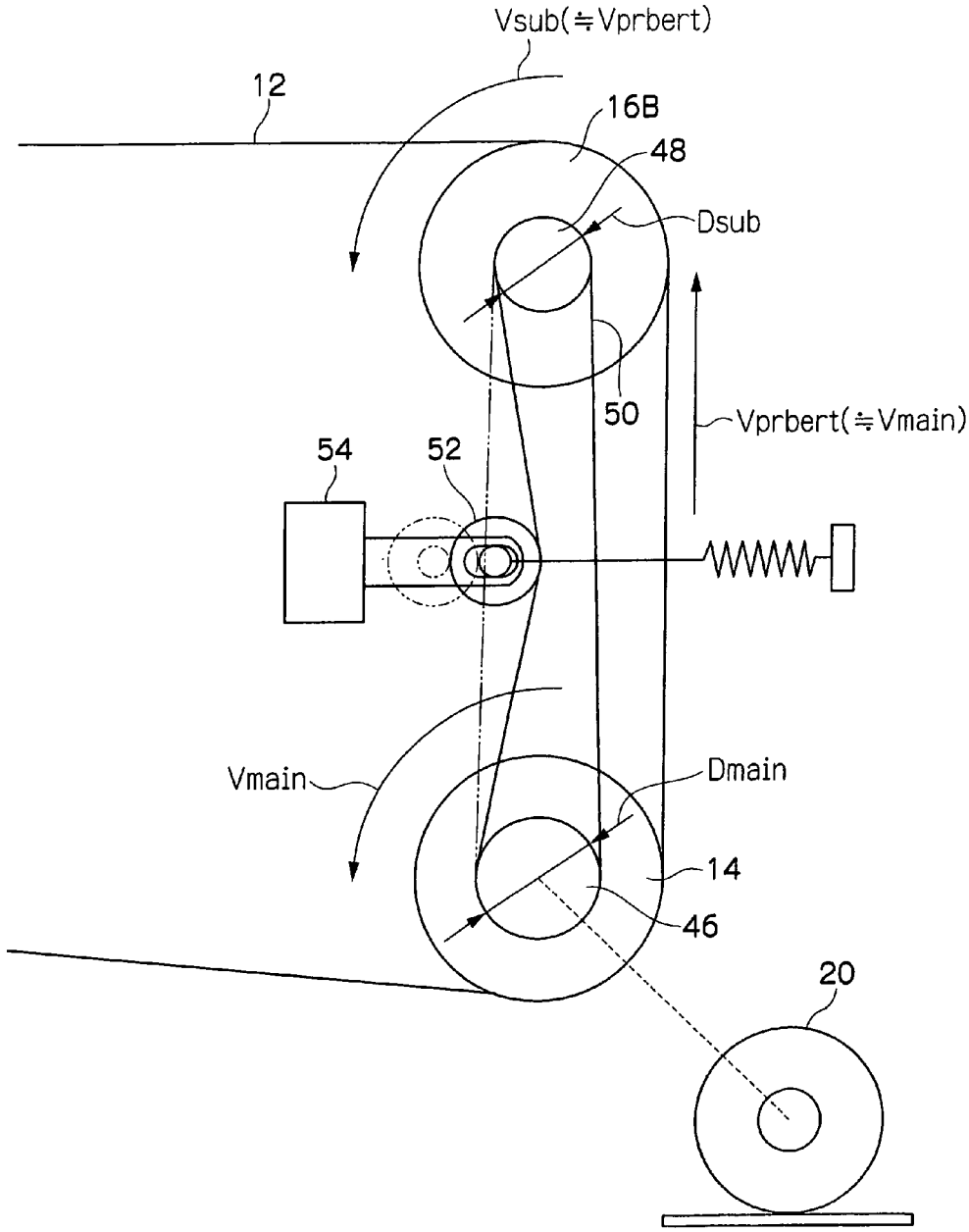
FIG. 3 is an enlarged view of a vicinity of a transfer section, and is a front view showing in detail a driving load reducing structure of the present invention.

As shown in FIGS. 2 and 3, a main pulley 46 is mounted to one axial direction end portion of the driving roller 14 (the end portion at the opposite side of the end portion to which the coupling 18 is mounted). At least the peripheral surface of the main pulley 46 is formed of a smooth aluminum.

On the other hand, an auxiliary pulley 48 is mounted to one axial direction end portion of the driven roller 16B. At least the peripheral surface of the auxiliary pulley 48 is formed of a smooth aluminum.

An endless flat belt 50 is trained around the main pulley 46 and the auxiliary pulley 48.

As a result, the driving force of the driving roller 14 is transferred to the driven roller 16B via the main pulley 46, the flat belt 50, and the auxiliary pulley 48. The driven roller 16B (which will be called "specific driven roller 16B" hereinafter) also functions as the driving roller 14.

The flat belt 50 is formed of a flexible synthetic resin which does not expand and contract. The dynamic friction coefficient, when the flat belt 50 is trained about the main pulley 46 and the auxiliary pulley 48 and driving force is transferred, is lower than the dynamic friction coefficient between the driving roller 14 and the photosensitive belt 12.

The outer diameter of the driving roller 14 (i.e., the outer diameter around which the photosensitive belt 12 is trained), and the outer diameter of the specific driven roller 16B (i.e., the outer diameter around which the photosensitive belt 12 is trained), are equal.

On the other hand, an outer diameter Dmain of the main pulley 46 (i.e., the outer diameter around which the flat belt 50 is trained) and an outer diameter Dsub of the auxiliary pulley 48 have the relationship Dmain>Dsub.

As a result, when the auxiliary pulley 48 is rotated from the main pulley 46 via the flat belt 50, theoretically, the auxiliary pulley 48 rotates faster than the main pulley 46.

However, the dynamic friction coefficient between, on the one hand, the flat belt 50, and, on the other hand, the main pulley 46 and the auxiliary pulley 48, is low. Therefore, therebetween, slipping arises, the difference in speeds is offset, and a rotating speed Vmain of the driving roller 14 and a rotating speed Vsub of the specific driven roller 16B become the same.

As a result, a speed (linear speed) v1 of the photosensitive belt 12 which is contacting the driving roller 14, and a speed (linear speed) v2 of the photosensitive belt 12 which is contacting the specific driven roller 16B, are substantially equal.

In this way, the photosensitive belt 12 is circulatingly driven by the driving force of the driving roller 14 and the driving force of the specific driven roller 16B. By dispersing the transfer positions of the driving force, the occurrence of non-uniform speed of the photosensitive belt 12 due to the driving load is reduced.

In the present embodiment, the difference between the outer diameter Dmain of the main pulley 46 and the outer diameter Dsub of the auxiliary pulley 48 which is most effective in reducing non-uniformity of speed, is, as expressed as a ratio, within the range:

$$1.02 \leqq (Dmain/Dsub) \leqq 1.06 \quad \text{formula (A).}$$

This has been confirmed experimentally (details will be described later).

These can be substituted by a rotating speed Vmain of the driving roller 14 and a rotating speed Vsub of the specific driven roller 16B in a state in which there is no photosensitive belt 12 (or in a state in which there is no load).

$$1.02 \leqq (Vsub/Vmain) \leqq 1.06 \quad \text{formula (B).}$$

Note that formula (B) is the same as formula (1) in the claims.

As shown in FIG. 3, a tension roller 52 contacts the flat belt 50. The both end portions of the rotating shaft of the tension roller 52 are guided so as to approach and move away from the flat belt 50. This movement is controlled by a tension controlling section 54.

Since the flat belt 50 does not extend and contract as described above, if a predetermined tension is not applied thereto, the driving force from the driving roller 14 is not reliably transferred to the specific driven roller 16B. Therefore, by pressing the tension roller 52 against the flat belt 50, the driving force of the driving roller 14 is transferred to the specific driven roller 16B.

When the driving roller 14 is driving, the tension controlling section 54 pushes the tension roller 52 against the flat belt 50 and applies tension. When the driving roller 14 is not driving, the tension controlling section 54 causes the tension roller 52 to move away from the flat belt 50.

It is possible to push the tension roller 52 against the flat belt 50 and apply tension only during a period of time when driving load which is greater than or equal to a predetermined load is applied (e.g., for a predetermined time from the start of driving of the driving roller 14, or the like).

A printing position accuracy characteristic (FIG. 4A) and a driving load characteristic (FIG. 4B), which are obtained from experimental results and which are for establishing the relationship of above formula (A) (as well as formula (B)), are illustrated.

Figures 4A, 4B:
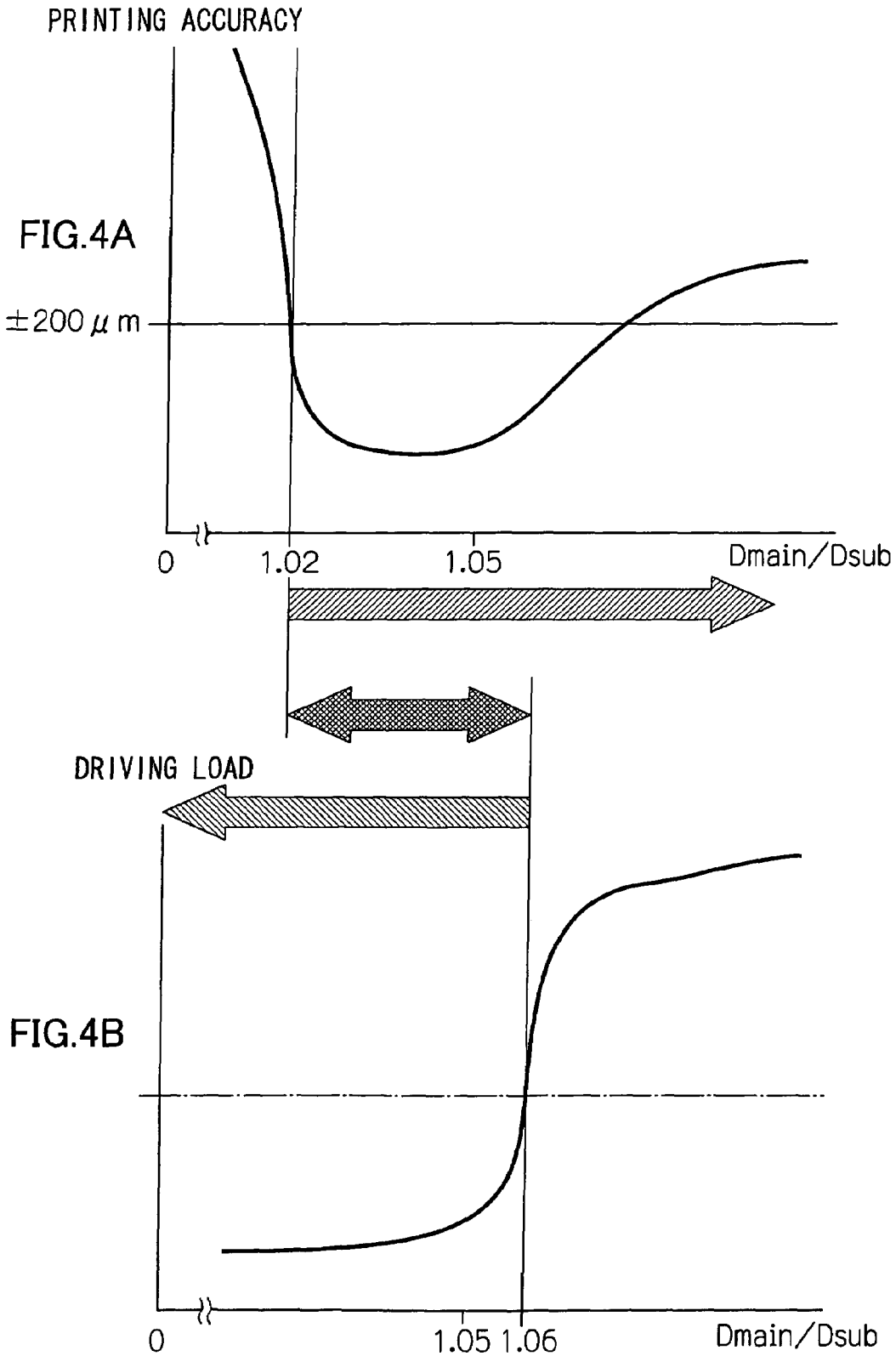
FIGS. 4A and 4B are functional block diagrams of a rotation controlling section, where

As shown in FIG. 4A, although the printing position accuracy characteristic differs for each image forming device, the borderline (threshold value) of good or poor is, for example, ±200 μm, and respective printing position accuracies a at an appropriate resolution are obtained with Dmain/Dsub (=Vsub/Vmain) being 0 to about 1.10. As shown in FIG. 4A, the range of Dmain/Dsub (=Vsub/Vmain) from the standpoint of the printing position accuracy is 1.02 to 1.08 (200 μm or less).

On the other hand, as shown in FIG. 4B, the driving load can be read from the current value of the motor which is the drive source. The appropriate value of the current value differs per image forming device, but a borderline (threshold value) which differentiates between good and poor to a certain extent is set. As shown in FIG. 4B, the range of Vsub/Vmain from the standpoint of the driving load is 1.00 to 1.06.

By combining these results, the relationship $1.02 < Dmain/Dsub\ (=Vsub/Vmain) \leqq 1.06$ is derived.

Operation of the present embodiment will be described hereinafter.

First, the image forming operation of the engine section 10 will be described.

When there is an image formation instruction, the motor is driven, and the driving roller 14 is rotated. In this way, the photosensitive belt 12 trained around the driving roller 14 starts circulating-driving in the direction of arrow A in FIG. 1.

Due to the lead portion (a position which is set in advance) of the photosensitive belt 12 passing by the charging section 22 from a reference position which is determined in advance, the surface (outer peripheral surface) of the photosensitive belt 12 is charged uniformly.

The uniformly-charged photosensitive belt 12 is fed into the exposure section 24. While the photosensitive belt 12 is supported by the platen 24A, an electrostatic latent image is formed thereon by the light beam from the light scanning device 24B.

The photosensitive belt 12, on which the electrostatic latent image is formed, is substantially inverted by the driven roller 16A, and reaches the developing section 26.

At the developing section 26, when toner is fed-out to the surface of the photosensitive belt 12 while being stirred, the toner which is charged negative (or positive) is attracted to the electrostatic latent image which is charged positive (or negative), and the electrostatic latent image is made visible such that a toner image is formed.

The photosensitive belt 12, on which the toner image is formed, passes by the charge-removing section 28, and reaches the entrance to the transfer section 30, i.e., the position at which the direction thereof is switched 90° by the driving roller 14.

On the other hand, the recording sheet 38 is conveyed-in through the conveying path 40 to the driving roller 14, in a state of being synchronous with the position at which the toner image is formed.

As a result, the recording sheet 38 is fit tightly to the surface of the photosensitive belt 12, which is trained around the driving roller 14 and whose direction has been switched by substantially 90°. In this tightly-fit state, the recording sheet 38 is conveyed in the vertical direction (upward in FIG. 1).

During this conveying in the vertical direction, the toner image of the photosensitive belt 12 is transferred onto the recording sheet 38 by passing by the transfer charging section 42 and charge-removing charging section 44.

The specific driven roller 16B is disposed at the final end position of the transfer section 30. The photosensitive belt 12 is trained around the specific driven roller 16B, the direction thereof is switched by substantially 90°, and the toner remaining thereon is scraped-off at the cleaner section 32. Thereafter, the photosensitive belt 12 returns to the reference position.

On the other hand, the recording sheet 38 advances straight ahead as is in the tangential direction from the position of the specific driven roller 16B, and, via the unillustrated fixing section, is discharged to the exterior of the device.

(Correction of Non-Uniform Speed of Photosensitive Belt 12)

Conventionally, the photosensitive belt 12 receives driving force only from the driving roller 14. The contact between the photosensitive belt 12 and the driving roller 14 is contact between rubber and PET, and the dynamic friction coefficient is high. However, when a driving load which is greater than needed is applied, that driving load concentrates at the contact surfaces of the driving roller 14 and the photosensitive belt 12, and slippage arises.

Thus, in addition to the driving roller 14, the specific driven roller 16B is also provided with the function of transferring driving force to the photosensitive belt 12.

This structure is realized by, in the engine section 10 of the above-described structure, mounting the main pulley 46 coaxially to the driving roller 14 which is positioned at the entrance of the transfer section 30, and mounting the auxiliary pulley 48 coaxially to the specific driven roller 16B which is positioned at the exit of the transfer section 30, and training the flat belt 50 therearound.

At least the peripheral surfaces of the main pulley 46 and the auxiliary pulley 48 are formed of smooth aluminum. The flat belt 50 is formed of a synthetic resin which is flexible and which does not expand and contract. Therefore, the dynamic friction coefficient at the time when the flat belt 50 is trained about the main pulley 46 and the auxiliary pulley 48 and driving force is transferred, is lower than the dynamic friction coefficient between the driving roller 14 and the photosensitive belt 12.

In other words, there is a structure which intentionally causes slippage at the time a difference arises between the conveying speed of the flat belt 50 by the main pulley 46 and the conveying speed of the flat belt 50 by the auxiliary pulley 48.

The outer diameter of the driving roller 14 and the outer diameter of the specific driven roller 16B are the same. The outer diameter Dmain of the main pulley 46 and the outer diameter Dsub of the auxiliary pulley 48 have the relationship Dmain>Dsub. When the auxiliary pulley 48 rotates from the main pulley 46 via the flat belt 50, theoretically, the auxiliary pulley 48 rotates faster than the main pulley 46, and as described above, slipping is caused between the flat belt 50 on the one hand and the main pulley 46 and the auxiliary pulley 48 on the other hand, such that the difference in speeds is offset.

Therefore, the rotational speed Vmain of the driving roller 14 and the rotational speed Vsub of the specific driven roller 16B are the same.

As a result, the speed (linear speed) v1 of the photosensitive belt 12 which is contacting the driving roller 14, and the speed (linear speed) v2 of the photosensitive belt 12 which is contacting the specific driven roller 16B, are substantially equal. The photosensitive belt 12 is circulatingly driven by the driving force of the driving roller 14 and the driving force of the specific driven roller 16B.

Namely, in the present embodiment, theoretically, it suffices for the driving roller 14 and the specific driven roller 16B to be driven by separate driving systems and rotated at the same speed. However, this is extremely difficult in actuality. In order to realize rotation at the same speed, the slippage between, on the one hand, the main pulley 46 and the auxiliary pulley 48, and, on the other hand, the flat belt 50, is utilized.

Experimental results make clear that a range of a given extent is preferable for the slippage between, on the one hand, the main pulley 46 and the auxiliary pulley 48, and, on the other hand, the flat belt 50, i.e., for the ratio (Dmain/Dsub) between the outer diameter Dmain of the main pulley 46 and the outer diameter Dsub of the auxiliary pulley 48.

Namely, if the ratio is small, there are cases in which the target printing position accuracy cannot be achieved. This is thought to be because, if the ratio is small, in terms of parts precision, a reversal arises in the speed difference, and slippage with the flat belt 50 arises at the driving roller 14 side, and conversely, the load may be redundant.

On the other hand, it is thought that, when the ratio is large, the amount of slipping between the specific driven roller 1}6B and the flat belt 50 increases, and conversely, a burden is applied to the driving roller 14.

Thus, in the present embodiment, the difference (ratio) between the outer diameter Dmain of the main pulley 46 and the outer diameter Dsub of the auxiliary pulley 48 which is most effective in reducing non-uniformity of speed, is set to the range:

$$1.02<(Dmain/Dsub)<1.06 \qquad \text{formula (A).}$$

The following formula results from substitution with the rotating speed Vmain of the driving roller 14 and the rotating speed Vsub of the specific driven roller 16B.

$$1.02<(Vsub/Vmain)<1.06 \qquad \text{formula (B).}$$

FIG. 4A is a characteristic diagram for setting the lower limit value of the above ratio Dmain/Dsub (=Vsub/Vmain). The vertical axis is the printing position accuracy. The printing accuracy differs at each image forming device, but the borderline (threshold value) of good or poor is set to be ±200 μm here, and it is judged whether the above ratio is good or poor. As a result, if the above ratio Dmain/Dsub (=Vsub/Vmain) is set to be 1.02 to 1.08, the printing accuracy can be made to be less than or equal to the threshold value of 200 μm.

FIG. 4B is a characteristic diagram for setting the upper limit value of the above ratio Dmain/Dsub (=Vsub/Vmain). The vertical axis is motor current values. Namely, the driving load can be read from the current value of the motor which is the drive source.

The appropriate value of the current value differs per image forming device, but a borderline (threshold value) which differentiates between good and poor to a certain extent is set, and it is judged whether the above ratio is good or poor. As a result, if Dmain/Dsub (=Vsub/Vmain) is made to be 1.00 to 1.06, the current value can be made to be less than or equal to the threshold value.

On the basis of the results of FIGS. 4A and 4B, if the relationship 1.02<Dmain/Dsub (=Vsub/Vmain)<1.06 is established, the driving load can be decreased and the printing accuracy may be improved.

As described above, in the present embodiment, the main pulley 46 is mounted coaxially to the driving roller 14, whereas the auxiliary pulley 48 is provided coaxially with the specific driven roller 16B. The flat belt 50 is trained around the pulleys, and by transferring the driving force of the driving roller 14 to the specific driven roller 16B as well, the driving load can be dispersed, and slipping of the photosensitive belt 12 can be reduced. At this time, the dynamic friction coefficient between the pulleys and the flat belt is lower than the dynamic friction coefficient between the driving roller and the photosensitive belt, and the specific driven roller 16B is rotated slightly faster, and the difference in speeds is offset due to the slipping between the pulleys and the flat belt. Therefore, it is possible to realize stable conveying with a reduction in the driving load by the driving roller 14 and the specific driven roller 16B. Note that, in the present embodiment, the specific driven roller 16B is made to be the driven roller 16B which is near to the driving roller 14 at the downstream side thereof. However, the driven roller 16A may be used, or another driven roller may be added. The driving force is transferred by the series-like system of the motor→the driving roller 14 (the main pulley 46)→the flat belt 50→the specific driven roller 16B (the auxiliary pulley 48). However, the flat belt 50 may be trained around three points which are the rotating shaft of the motor, the main pulley 46, and the auxiliary pulley 48, and the driving force may be transferred directly to the main pulley 46 and the auxiliary pulley 48 (in this case, the main/slave relationship does not exist).

In the present embodiment, the difference in speeds is offset by using the slippage between, on the one hand, the main pulley 46 and the auxiliary pulley 48, and, on the other hand, the flat belt 50. However, a structure which offsets the difference in speeds by using a bearing incorporated in a commercially-available one-way clutch, or the like, may be used.

An embodiment of the present invention is described above, but the present invention is not limited to the embodiment as will be clear to those skilled in the art. Namely, a first aspect of the present invention is an image forming device having an endless-belt shaped image carrier which circulates along a predetermined locus of movement and is trained around a plurality of rollers structured by at least one driving roller, which receives driving force from a drive source and drives, and driven rollers which do not have drive force, the image forming device executing at least respective processings of charging, exposure, developing, and transfer at appropriate positions on a locus of circulation of the image carrier, and transferring an image onto a transfer member in the transfer processing, and including: a dynamic friction connecting unit which, by dynamically-frictionally connecting the driving roller and at least one of the driven rollers under a predetermined dynamic friction coefficient, dynamically-frictionally drives the at least one driven roller by driving force of the driving roller.

In the first aspect, the dynamic friction connecting unit may be structured by a driving pulley formed coaxially with the driving roller, a driven pulley formed coaxially with the at least one driven roller (hereinafter, "specific driven roller"), and a flat belt which is formed of a non-elastic member and is trained around the driving pulley and the driven pulley, and a dynamic friction coefficient between the driven pulley and the flat belt may be set to be lower than the predetermined dynamic friction coefficient. As the structure of the dynamic friction connecting unit, the dynamic friction connection unit has: the driving pulley formed coaxially with the driving roller, the driven pulley formed coaxially with the specific driven roller, and the flat belt which is formed of a non-elastic member and is trained around the driving pulley and the driven pulley. The dynamic friction coefficient between the driven pulley and the flat belt is set to be lower than the predetermined dynamic friction coefficient.

In this way, the rotating speeds of the driving roller and the specific driven roller can be maintained constant.

Further, in the first aspect, a ratio of a surface speed Vmain of the driving roller and a surface speed Vsub of the specific driven roller in a case in which load applied from the image carrier is zero, may be in a range whose lower limit value is specified by printing accuracy and whose upper limit value is specified by driving load.

Further, the ratio of Vmain and Vsub may be within a range of formula (B).

$$1.02<(Vsub/Vmain)<1.06 \qquad \text{formula (B)}$$

In a case in which the load applied from the image carrier is zero, i.e., when the driving roller and the specific driven roller drive with no load, at the range of the ratio of the surface speed Vmain of the driving roller and the surface speed Vsub of the specific driven roller, the lower limit value is specified by the printing accuracy and the upper limit value is specified by the driving load.

If the aforementioned ratio is smaller than a predetermined value (Vsub/Vmain=1.02, as a threshold value determined from experimental results), when there is a driving load, the speed stability of the driving roller and the specific driven roller is poor, and fluctuations in the speed of the image carrier arise. On the other hand, if the ratio is greater than a predetermined value (Vsub/Vmain=1.06, as a threshold value determined from experimental results), when there is a driving load, there is a time loss until the speed of the specific driven roller becomes stable, and rapid stabilization and control of speed are difficult.

Thus, by specifying the ratio Vsub/Vmain, image forming processing in an optimal mode can be realized.

Further, in the first aspect, a correlation of the dynamic friction coefficients may be set such that a slip torque F1 between the driving roller or the specific driven roller and the image carrier, is greater than a slip torque F2 between the driving pulley or the driven pulley and the flat belt.

As a concrete means for setting the correlation of the dynamic friction coefficients, the slip torque F1 between the driving roller or the specific driven roller and the image carrier, is made to be larger than the slip torque F2 between the driving pulley or the driven pulley and the flat belt. As a result, the target correlation between the dynamic friction coefficients can be achieved.

In the first aspect, the specific driven roller may be provided near to and at a downstream side of the driving roller.

Due to the specific driven roller being, among the plurality of driven rollers, the nearest to the driving roller and at the downstream side of the driving roller, the dispersing of the driving load can be carried out most efficiently. Further, by placing the processing (e.g., the transfer processing) step, which causes the driving load, between the driving roller and the specific driven roller, the dispersing of the driving load can be utilized effectively.

Further, the image forming device of the first aspect may further have: a tension adjusting mechanism applying a predetermined tension to the flat belt; and a tension controlling unit which controls the tension adjusting mechanism so as to, while the driving roller is driving, apply a predetermined tension to the flat belt, and, while the driving roller is not driving, release the tension applied to the flat belt.

Moreover, the tension controlling unit may control the tension adjusting mechanism for a predetermined time from the start of driving of the image carrier, and apply the predetermined tension to the flat belt.

Tension by the tension adjusting mechanism can be applied to the flat belt. This tension is applied by the tension controlling unit only while the driving roller is driving.

Accordingly, the speed of the image carrier is stable, and extension and contraction of monochrome images and color offset of color images (including full-color images) may be prevented.

What is claimed is:

1. An image forming device comprising:

an endless-belt shaped image carrier that circulates along a predetermined locus of movement and is trained around a plurality of rollers;

the plurality of rollers being structured by at least one driving roller that receives driving force from a drive source and drives;

driven rollers that do not have drive force; and a dynamic friction connecting unit that, by dynamically-frictionally connecting the driving roller and at least one of the driven rollers under a predetermined dynamic friction coefficient using a flat belt, dynamically-frictionally drives the at least one driven roller by driving force of the driving roller;

a tension adjusting mechanism applying a predetermined tension to the flat belt; and a tension controlling unit controlling the tension adjusting mechanism in accordance with the driving force.

2. The image forming device of claim 1, wherein the dynamic friction connecting unit is structured by a driving pulley formed coaxially with the driving roller, a driven pulley formed coaxially with the at least one driven roller, and the flat belt that is formed of a non-elastic member and is trained around the driving pulley and the driven pulley, and a dynamic friction coefficient between the driven pulley and the flat belt is set to be lower than the predetermined dynamic friction coefficient.

3. The image forming device of claim 2, wherein a ratio of a surface speed Vmain of the driving roller and a surface speed Vsub of the at least one driven roller in a case that load applied from the image carrier is zero, is in a range of from lower limit value specified by printing accuracy and upper limit value specified by driving load.

4. The image forming device of claim 3, wherein the ratio of Vmain and Vsub is within a range of formula (1):

$$1.02 \leqq (Vsub/Vmain) \leqq 1.06 \quad \text{formula (1).}$$

5. The image forming device of claim 2, wherein a correlation of the dynamic friction coefficients is set such that a slip torque F1 between the driving roller or the at least one driven roller and the image carrier, is greater than a slip torque F2 between the driving pulley or the driven pulley and the flat belt.

6. The image forming device of claim 1, wherein a ratio of a surface speed Vmain of the driving roller and a surface speed Vsub of the at least one driven roller in a case that load applied from the image carrier is zero, is in a range of from lower limit value specified by printing accuracy and upper limit value specified by driving load.

7. The image forming device of claim 6, wherein the ratio of Vmain and Vsub is within a range of formula (1):

$$1.02 < (Vsub/Vmain) < 1.06 \quad \text{formula (1).}$$

8. The image forming device of claim 1, wherein the at least one driven roller is provided near to and at a downstream side of the driving roller.

9. The image forming device of claim 1, wherein the tension controlling unit controls the tension adjusting mechanism so as to, while the driving roller is driving, apply the predetermined tension to the flat belt, and, while the driving roller is not driving, release the tension applied to the flat belt.

10. The image forming device of claim 9, wherein the tension controlling unit controls the tension adjusting mechanism for a predetermined time from a start of driving of the image carrier, so as to apply the predetermined tension to the flat belt.

11. An image forming device comprising:

a driving roller receiving driving force from a drive source;

a plurality of driven rollers;

an endless-belt shaped image carrier that is trained around the driving roller and the driven rollers, and circulates along a predetermined locus of movement; and a dynamic friction connecting unit that frictionally drives at least one driven roller among the driven rollers using a flat belt, by driving force of the driving roller;

a tension adjusting mechanism applying a predetermined tension to the flat belt; and a tension controlling unit controlling the tension adjusting mechanism in accordance with the driving force.

12. The image forming device of claim 11, wherein, in a case that load applied from the image carrier is zero, a ratio of a surface speed Vmain of the driving roller and a surface speed Vsub of the at least one driven roller is in a range of from lower limit value specified by printing accuracy and upper limit value specified by driving load.

13. The image forming device of claim 12, wherein the ratio of Vmain and Vsub is within a range of formula (1):

$$1.02 \leqq (Vsub/Vmain) \leqq 1.06 \quad \text{formula (1).}$$

14. The image forming device of claim 11, wherein the at least one driven roller is provided near to and at a downstream side of the driving roller.

15. The image forming device of claim 11, wherein the dynamic friction connecting unit is structured by:

a driving pulley formed coaxially with the driving roller;

a driven pulley formed coaxially with the at least one driven roller; and a dynamic friction coefficient between the driven pulley and the flat belt is set to be lower than a dynamic friction coefficient between the driving roller and the image carrier, wherein the flat belt has a non-elastic member that is trained around the driving pulley and the driven pulley.

16. The image forming device of claim 15, wherein a correlation of the dynamic friction coefficients is set such that a slip torque F1 between the driving roller or the at least one driven roller and the image carrier, is greater than a slip torque F2 between the driving pulley or the driven pulley and the flat belt.

17. The image forming device of claim 15, wherein outer diameters of the driving roller and the at least one driven roller are substantially the same, and a ratio of an outer diameter Dsub of the driven pulley and an outer diameter Dmain of the driving pulley is in a range of from lower limit value specified by printing accuracy and upper limit value specified by driving load.

18. The image forming device of claim 17, wherein the ratio of Dsub and Dmain is within a range of formula (2):

$$1.02 \leqq (Dsub/Dmain) \leqq 1.06 \quad \text{formula (2).}$$

19. The image forming device of claim 15, further comprising:

a tension adjusting mechanism applying a predetermined tension to the flat belt; and a tension controlling unit controlling the tension adjusting mechanism so as to, while the driving roller is driving, apply a predetermined tension to the flat belt, and, while the driving roller is not driving, release the tension applied to the flat belt.

20. The image forming device of claim 19, wherein the tension controlling unit controls the tension adjusting mechanism for a predetermined time from a start of driving of the image carrier, so as to apply the predetermined tension to the flat belt.

* * * * *